United States Patent [19]

Huber

[11] 4,259,928

[45] Apr. 7, 1981

[54] CONTINUOUS FLOW WATER HEATER

[76] Inventor: Ludwig Huber, Saarland St. 15, 7000 Stuttgart 80, Fed. Rep. of Germany

[21] Appl. No.: 35,376

[22] Filed: May 3, 1979

[30] Foreign Application Priority Data

Jun. 13, 1978 [DE] Fed. Rep. of Germany ..... 2825809

[51] Int. Cl.[3] ..... F22B 31/00

[52] U.S. Cl. ..... 122/24; 431/1

[58] Field of Search ..... 122/24; 431/1; 60/39.76, 39.77

[56] References Cited

U.S. PATENT DOCUMENTS

| | | | |
|---|---|---|---|
| 2,703,565 | 3/1955 | Lustig | 122/24 X |
| 2,965,079 | 2/1960 | Collinson | 122/24 |
| 3,091,224 | 5/1963 | Rydberg | 122/24 |
| 3,192,986 | 7/1965 | Haag | 431/1 |
| 3,267,985 | 8/1966 | Kitchen | 122/24 X |

FOREIGN PATENT DOCUMENTS

| | | |
|---|---|---|
| 1911193 | 4/1971 | Fed. Rep. of Germany . |
| 1922650 | 11/1972 | Fed. Rep. of Germany . |
| 1911192 | 9/1973 | Fed. Rep. of Germany . |

OTHER PUBLICATIONS

Betriebs-Okonom, *Procedures With Gas Operated Resonant or Pulsating Combustion Heater Mechanisms,* Nos. 1 and 2, 1970.

Betriebs-Okonom, *Gas Operated Resonant or Pulsating Burners in Foreign Countries, No. 5, pp. 96-100, 1970.*

Betriebs-Okonom, *Automatic Starting Process of Resonant or Pulsating Combustion Heating Mechanisms,* No. 8, pp. 150-162, 1970.

Engineering Association of Worttemberg, *Gas Operated Resonant or Pulsating Combustion Heater Mechanisms,* Mar. 1959.

*Primary Examiner*—Edward G. Favors

*Attorney, Agent, or Firm*—Michael F. Petock

[57] ABSTRACT

A continuous flow water heater utilizes a submersible pulsating heating mechanism. A continuous flow water heater is provided with a caldron which may be closed by means of a cover. The pulsating heating mechanism may be mounted to the caldron cover with the pulsating heating mechanism and the cover being readily removable. The pulsating heating mechanism extends downward into the caldron. The pulsating heating mechanism is formed by a vertically standing sound muffling air cylinder with an intake muffler, a combustion chamber and a pulsation pipe connected to the combustion chamber. The pulsation pipe exhausts into a cylindrically shaped substantially vertically mounted exhaust muffler cylinder mounted adjacent to the air cylinder within the caldron. The caldron may be made of a synthetic material as the highest temperature which it must withstand is that of the temperature of the water to be heated. The water to be heated enters from the bottom of the caldron, is heated by the air and exhaust cylinders as it rises, and is heated to its highest temperature near the top of the caldron where it exits by means of a pretzel-shaped pulsation pipe. The heating capacity may be doubled by using a second substantially identical pulsating heating mechanism which operates 180° out of phase without increasing the volume of the exhaust cylinder.

16 Claims, 13 Drawing Figures

CONTINUOUS FLOW WATER HEATER

BACKGROUND OF THE INVENTION

The present invention relates to a continuous flow circulatory water heater. More particularly, the present invention relates to a new and improved continuous flow water heater which utilizes a submersible removable pulsating heating mechanism arranged to provide maximum heating efficiency wherein the water is preheated as it rises from the bottom to the top of the caldron, and is heated to its maximum temperature by a pretzel-shaped pulsating pipe prior to exiting the caldron near the top of the caldron.

Continuous flow water heaters of the type disclosed herein are known. For example, reference may be had to German Patent Publication No. DE PS 1,922,650. Further, in particular, the principles in design of the pulsation heater mechanisms utilized herein are known to those skilled in this art. For example, further reference may be had to German Patent Publication Nos. DE PS 1,911,192 and 1,911,193, and to articles published by the inventor herein, namely, in the magazine Betriebs-Ökonom, No's. 1 and 2 (1970) regarding *Procedures with Gas Operated Resonant or Pulsating Combustion Heater Mechanims,* in No. 5 (1970) pp. 96–100, concerning *Gas Operated Resonant or Pulsating Burners in Foreign Countries* and, in No. 8 (1970) pp. 150–162, on *Automatic Starting Process of Resonant or Pulsating Combustion Heating Mechanisms During the Course of their Development,* and a special publication entitled *Gas Operated Resonant or Pulsating Combustion Heater Mechanisms,* published by the Engineering Association of Württemberg in VDI, presented on the occasion of the conference in Stuttgart on Mar. 5, 1969. The bibliographical references cited in this literature are also worthy of note. In view of this known prior art, a detailed description of the operation of the pulsation heater system will not hereinafter be necessary.

Although continuous flow heater systems are known, the design of a continuous flow hot water system has not yet been optimized. It is an object of the present invention to further develop continuous flow water heaters in such a manner that the individual parts, particularly the intake muffler, the exhaust muffler and the circulation system formed by the combustion chamber and the pulsation pipe, are located in the smallest possible space with the best possible utilization of the space within the volume provided within the caldron. It is a further object of the present invention to provide an arrangement of the operating elements to make the operation of the continuous flow water heater as efficient as possible.

High efficiency of operation is especially important today where there is often a shortage of fuel, and if not a shortage, the cost of fuel is usually rather high. Therefore, efficiency in water heating systems is especially important. Resonant or pulsating combustion heating systems, especially gas fired, are becoming increasingly attractive and may achieve a very high degree of efficiency, possibly up to 99%. Therefore, pulsating combustion systems in accordance with the present invention are particularly appropriate for the solution of heating problems of the future. This is especially the case since it is possible to use explosive materials in the combustion material which could not be burned with an open flame. Thus, the present invention may utilize gases which cannot be burned with an open flame, such as hydrogen or mixtures with a high hydrogen content. There also existed a need for further inventive development in the area of continuous flow water heaters to provide an arrangement wherein the heating elements are arranged in the form of a dip-stick to be immersed in the water so that the material of the caldron was not exposed to a higher temperature than that to which the water will be heated. In this manner, it is even possible to use a synthetic material for the construction of the caldron thereby solving problems such as corrosion and the high cost of conventional prior art caldrons. In addition, the water surrounding the submerged heater unit also serves the function of a sound muffler.

In the case of known mechanisms, an optimal heating of the water circulating or continuously flowing through the container from water intake to water outlet has not, in fact, been achieved. Further, in known devices, the exhaust muffler surrounding the intake muffler in the approximate shape of a ring, caused a certain waste of space in consideration of the diameter of the total mechanism. Further, it should be taken into consideration that in order to achieve the necessary length of the pulsation pipe for a stable pulsation process, an arrangement with relatively great expenditure of cross sectional space must be selected in the mechanism shown there. The latter is necessitated in that there must be resonant conditions at approximately 120 Hz. It could be said that the length of the pulsation pipe is a constant to be considered here, one which nevertheless must be realized in a small space by means of a correspondingly curved shape, while on the other hand, a small curve radius should be avoided wherever possible due to the flow resistance thereby encountered.

SUMMARY OF THE INVENTION

According to the invention, the above-mentioned objects are accomplished by the apparatus set forth in the claims. In addition, the disclosure of the invention describes several other advantageous developments.

Briefly and basically the advantages of the present invention are achieved through the arrangement of an air cylinder, with an exhaust muffler, as basically cylindrical bodies, standing vertically next to each other, above which the pulsation pipe is located. An optimal space utilization within the caldron has been achieved by intake of the water from below and outlet therefrom at the top, that is, closely above the area in which the pulsation pipe is located. The heating results in a "thermosiphon" effect with the result that the water is preheated by the other parts before reaching the area where the pulsation pipe is located, and the water leaves the caldron at a point near the pulsation pipe where it reaches its highest temperature. By means of this arrangement of the pulsation pipe above the two vertical, basically cylindrical bodies located next to each other, namely the air cylinder and the exhaust cylinder, the advantageous development of the invention is achieved which is made possible through the pretzel shape of the pulsation pipe. This shape utilizes the space thus formed in a highly efficient manner, especially where according to a further development of the invention two pulsation firing systems formed by combustion chamber and pulsation pipe are mounted above each other at relatively little distance. In this manner, a relatively simple doubling of the performance is possible with otherwise identical individual parts. This shape also facilitates a relatively large curve radius, thus comparatively low flow resistance, although the cross-sectional area transversed by the water flow is, in fact, completely covered, especially when the combustion chambers are also taken into consideration as heat sources. This construction is further facilitated by the fact that pipes, which can be disconnected from the cover or lid covering the caldron, are led through the interior of the caldron providing intake or outlet for gas, fresh air, electricity, exhaust, etc. Thereby, the space possibly not occupied by the pretzel shape of the pulsation pipe and the combustion chamber is completely filled so that, practically, the heating can be uniformly achieved over the entire cross-section of the flow area. In this manner, efficiency coefficients of up to 99% of the so called "low heat value" may be achieved. In addition, even the "high heat value" may be utilized. According to an additional development of the invention, the conduits provided for transfer of air (fresh air intake) to the air cylinder may also be utilized as space for additional intakes such as, gas, starter air, and electrical wiring. Thereby additional sound muffling is achieved simultaneously.

An additional definite advantage is achieved thereby that the entire pulsating combustion immersion heating arrangement may be attached to the cover placed on the caldron in such a manner that that this mechanism can be removed by disconnecting the connectors and gaskets between caldron and cover, and all assembly and/or testing and/or service work may be performed on the unit. Specifically, this also facilitates testing during manufacturing.

Further, with this arrangement in the caldron in accordance with the present invention the heat producing parts are surrounded by minimal water distance.

In total, the described arrangement of individual parts makes it possible to achieve a much lower total height than was previously possible. Thus, a mechanism of this type is also suitable for mounting in or at hot water reservoirs for swimming pools, kitchens and as supplementary heating in conjunction with heat pumps, particularly absorption heat pumps and solar heating mechanisms.

The simplicity of improving performance makes it possible to realize performance variations of 10,000 Kcal/h with exactly identical measurements of the caldron; if the cross-section of conduits for fresh air and fuel are correspondingly designed, which is easily done, the performance may be doubled by mounting two pulsation systems above each other with little difference in elevation. When coupling these pulsation systems in such a manner that they work in counter-action, that is with a phase shift of 180°, no enlargement of the intake and muffler cylinders is necessary, since the pressure peaks of the detonations are equally high and only the frequencies are doubled corresponding to the dual arrangement.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. *3a* is a view in perspective of a cover housing for a continuous flow water heater apparatus in accordance with the present invention.

FIG. *3b* is a view in perspective of a resonant or combustion immersion heater apparatus for use in a continuous flow heater apparatus in accordance with the present invention.

FIG. *3c* is a view in perspective of a caldron in accordance with the present invention.

FIG. *3d* is a view in perspective of a housing for supporting the caldron of FIG. *3c* in accordance with the present invention.

FIG. *3e* is an elevation view of a resonant or pulsating combustion immersion heater apparatus mounted in a test tank in accordance with the present invention.

FIG. *3f* is an elevation view of a continuous flow water heater apparatus without a housing cover in accordance with the present invention.

FIG. *3g* is an elevation view of a caldron mounted on a housing prior to the installation of a pulsation combustion immersion heater and cover.

FIG. *3h* is an elevation view of a continuous flow water heater apparatus in accordance with the present invention.

Figure 4:
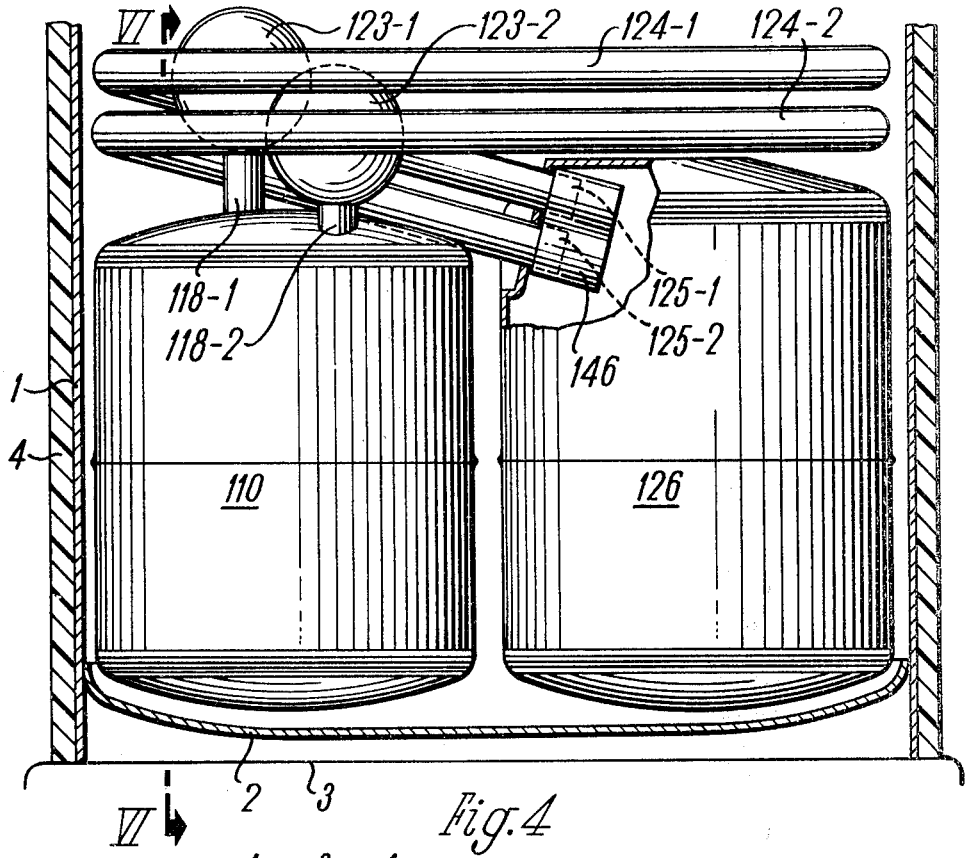

FIG. 4 is a partial cross-sectional elevation view of another embodiment of the present invention utilizing two pulsating combustion chambers in accordance with the present invention.

Figure 5:
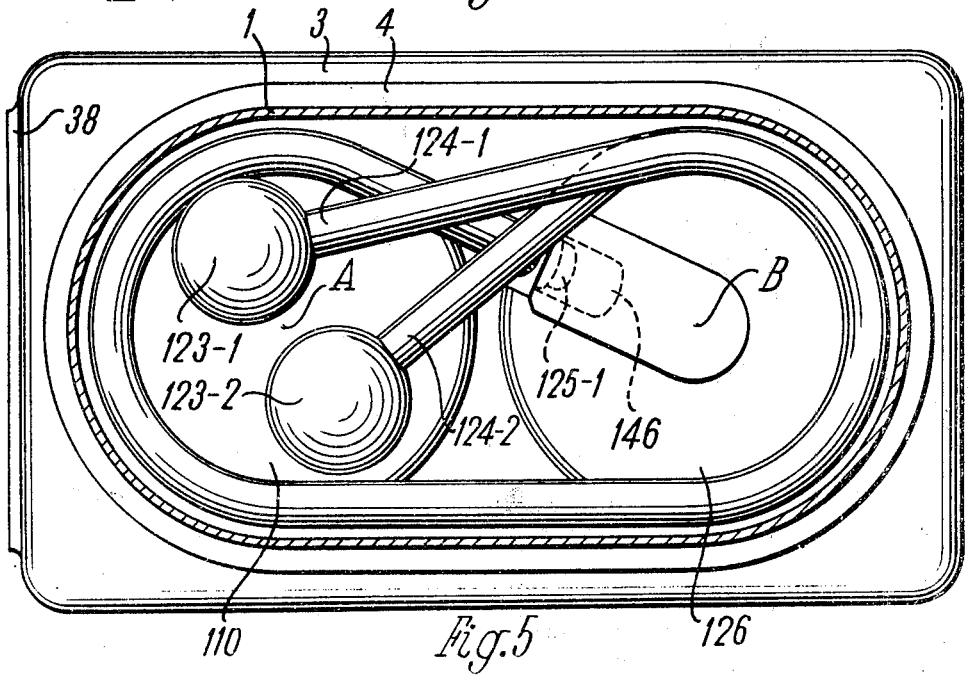

FIG. 5 is a plan cross-sectional view of the embodiment of FIG. 4 in accordance with the present invention.

Figure 6:
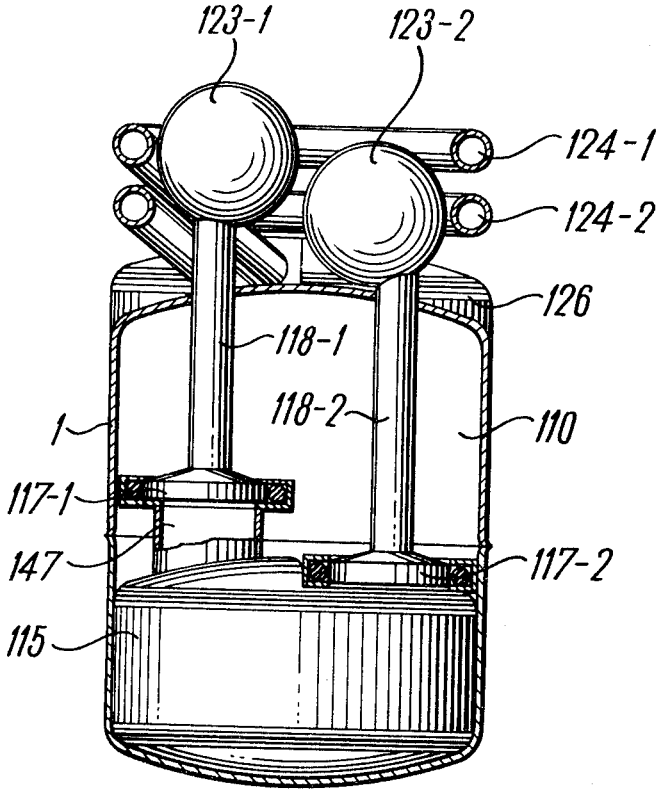

FIG. 6 is a cross-sectional view taken along line VI—VI of FIG. 4.

DETAILED DESCRIPTION OF THE PREFERRED EMBODIMENTS

Figure 1:
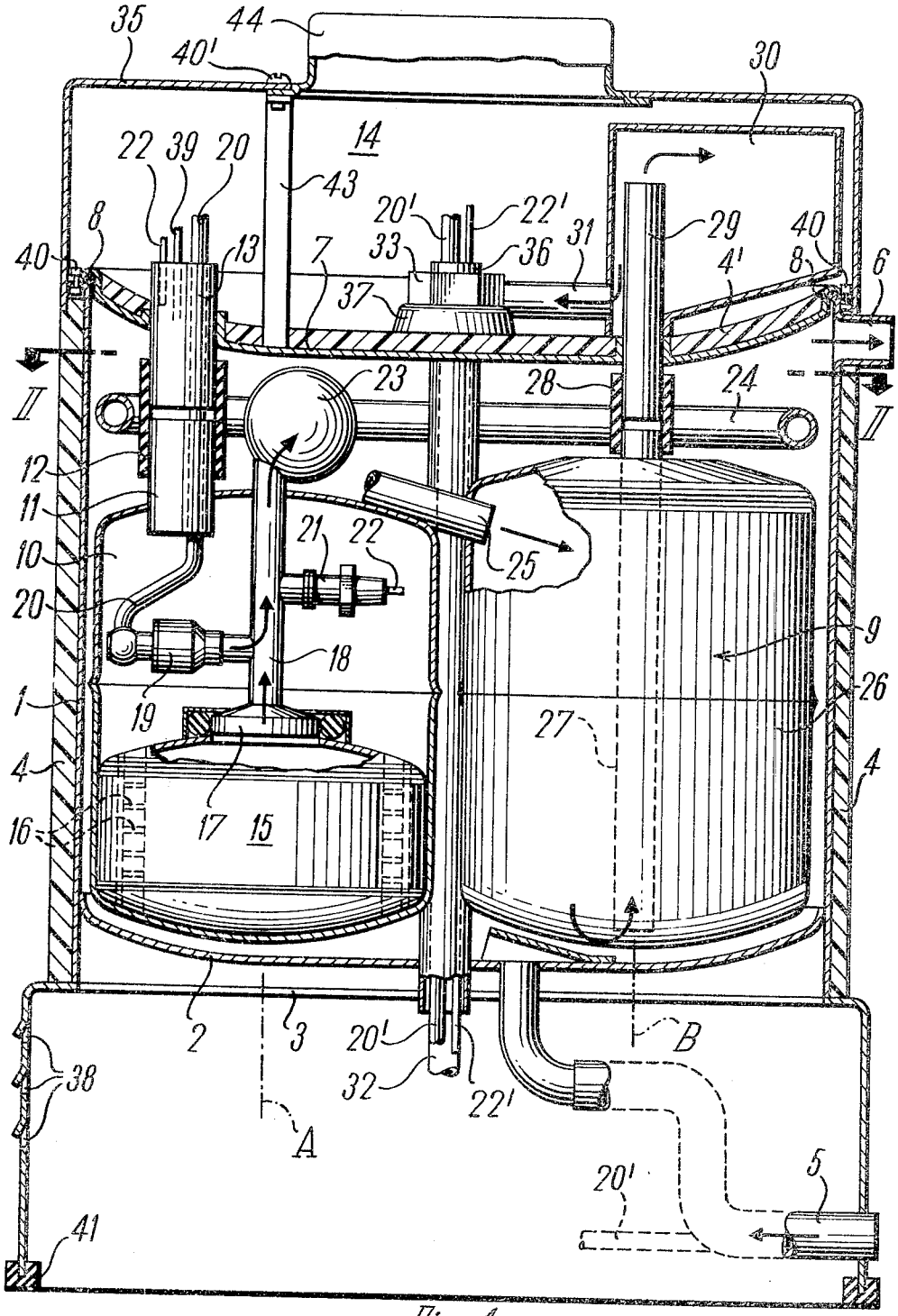
FIG. 1 is cross-sectional view of a continuous flow water apparatus in accordance with the present invention.

Referring now to the drawings in detail wherein like numerals indicate like elements, the continuous flow water heater according to FIG. 1 is comprised of a caldron 1, with a bottom 2 which rests on a housing 3. It is insulated by means of an insulation layer 4. In the bottom of the caldron, water is provided into the caldron by means of a water intake 5. By using the continuous flow water heater in a closed water circuit, this is the so called recoil, the water rises in the caldron after heating as described in the following and exits from the caldron through water outlet 6, the so called first run. At the top, caldron 1 is closed by cover 7, which is sealed to caldron 1 by means of gaskets 8. Cover 7 is provided with an insulation layer 4. From cover 7, resonant or pulsating combustion immersion heater mechanism 9 extends downwards into caldron 1.

The principles of operation and the design of resonant or pulsation combustion heaters are known and reference should be had to the German patent publications and the publications of the inventor herein referred to supra in the Background of the the Invention. Briefly the resonant or pulsating combustion immersion heater is comprised of air cylinder 10 in which pipe support 11 enters, which is connected with a permanently attached additional pipe support 13 in cover 7 via elastic hose 12, in order to provide air into air cylinder 10 from space 14 above cover 7. Air cylinder 10 includes an intake muffler 15 in which air enters from air cylinder 10 via entrance opening 16. Air from intake muffler 15 enters mixing pipe 18 via non-return valve 17. Gas serving as fuel is provided via conduit 20 to gas intake 19 and from which the gas exits into mixing pipe 18. Spark plug 21 is used for initiation of the combustion process when starting the pulsating combustion operation. High voltage is provided to spark plug 21 via wire 22. Combustion of the gas/air mixture takes place in combustion chamber 23 which is connected with mixing pipe 18. Pulsation pipe 24 is formed as may be best seen in FIG. 2 into a shape which may be referred to as "pretzel shape". The end 25 of pulsation pipe 24 extends into exhaust cylinder 26. Exhaust cylinder 26 is designed to serve as a sound muffler. Exhaust cylinder 26 is provided with an exhaust pipe 27 having an open end at the bottom, said open end ending near or just closely above the bottom of exhaust cylinder 26. Exhaust pipe 27 is connected via elastic hose 28 with pipe support 29. Pipe support 29 is attached to cover 7. An additional or second muffler 30 receives the exhaust from the upper end of pipe 29, which also serves as a pipe support for exhaust cylinder 29. The exhaust gases are eliminated from muffler 30 via connecting conduit 31 and exhaust pipe 32 (See FIGS. 1 and 2).

The connection of connecting conduit 31 with exhaust pipe 32 occurs by means of a screw connection 33 in such a manner that it can be disconnected. In such a manner that they may be disconnected, the conduits 20, 22 are connected with the conduits 20', 22', respectively, and these connections (not shown) are located above the cover 7 in the space 14 within housing cover 35, which space is provided for the instrumentation. Screw connection 33 is designed in such a manner that it constitutes a disconnectable connection of the exhaust pipe 32 with cover 7, so that when this connection is disengaged, the cover 7 may be removed. Exhaust pipe 32 is permanently attached under bottom 2 of the caldron 1.

Further, vertical pipe 36 is permanently attached to bottom 2 of caldron 1 and attached to cover 7 by means of a screw connection which may be disengaged. When this screw connection is disengaged, cover 7 may be removed from the vertical pipe 36. Conduit 20' for gas intake, which is connected with conduit 20, and wire 22', for providing electricity to the spark plug 21, which is connected with conduit 22, are both led through the vertical pipe 36 to the connection points in the housing 3. In addition, fresh air is sucked in through the vertical pipe 36. This occurs from the housing 3, where the fresh air can enter, dust free, through a slot 38 and an air filter (not shown). This is a significant advantage over systems with an open flame, where the combustion process would necessitate measures requiring additional air, if a filter were introduced. In the manner described, sufficient masses of fresh air can at any time flow via the slot 38, the interior of the housing 3 and the vertical pipe 36 into the space 14 above the cover 7 and within the cover housing 35, so that the air may then be sucked into the pulsating combustion system consisting of combustion chamber 23 and pulsation pipe 24 via the two pipe supports 11 and 13 at intake muffler 15. An additional conduit 39 is also led through the pipe supports 11 and 13. This conduit serves to provide air for the starter. Cover 7 is attached to caldron 1 by means of screws 40. The cover housing 35 is placed on top and attached by means of screws 40' to supports 43. After disengagement of screws 40 and 40' as well as screw connections 33 and 37, caldron cover 7 with the complete pulsation immersion heater system 9 may be removed, so that service work, etc., may be performed on the entire unit in an extremely simple manner. Above caldron cover 7 and in connection with the conduits and pipes shown, further instrumentation (not shown) is also provided within cover housing 35.

As may be seen, cold water enters caldron 1 via water intake 5 from below and flows around air cylinder 10, exhaust cylinder 26, as well as combustion chamber 23 and pulsation pipe 24. Thereby, the water contributes significantly to further muffling of sound, that is, in addition to the mufflers. Then, the water is heated above air cylinder 10 and exhaust cylinder 26 by means of heat radiation from pulsation pipe 24, whereafter it leaves slightly above this area through water outlet 6. By heating the water in the upper part of caldron 1, a constant flow of water upwards from below is achieved by means of the thermo-siphon effect, which also contributes to optimal performance efficiency by means of the water exiting in the area of the most intensive heating, that is, in the area closely above the heating effect of pulsation pipe 24. The above-mentioned efficiency co-efficients may be noted in conjunction with the desirable characteristics of the gas operated pulsation heating mechanisms. A reduction of vibrations is achieved by means of mounting air cylinder 10 and exhaust cylinder 26 on elastic hoses 12 and 28, respectively. Sound muffling is achieved through the mufflers as well as the arrangement of the various conduits, for example 22, 39, 20', 22', inside pipes. Additional vibration reduction is achieved by means of the entire unit standing on rubber feet 41.

Figure 2:
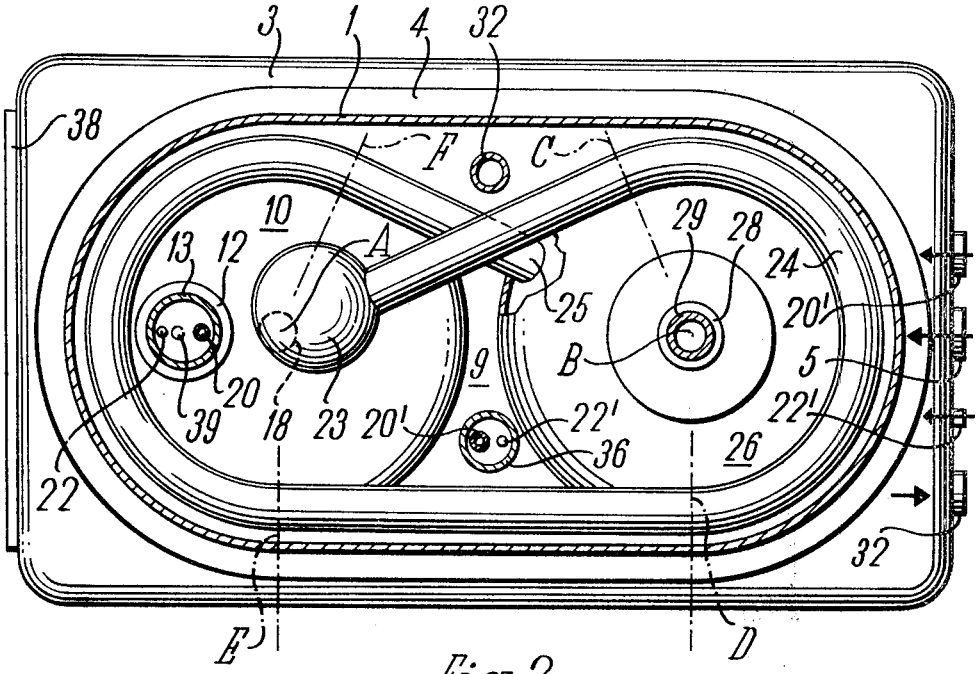
FIG. 2 is a cross-sectional view taken along line II—II of FIG. 1.

FIG. 2 shows specifically the arrangement of pulsation pipe 24. Its length is determined by the resonance conditions at vibrations of 100–125 Hz; its length thus not variable. The illustrated arrangement solves the problem of arranging a pulsation pipe particularly well and with maximum efficiency in the smallest space possible. Specifically, the illustrated arrangement allows the largest possible curve radius and thereby provides low flow resistance in the interior of the pulsation pipe, as well as minimal space requirement, while at the same time facilitating the arrangement of the pulsation pipe at the position most advantageous for circulatory heating.

The course of pulsation pipe 24 may be described as follows if A and B stand for the vertical axes of air cylinder 10 and exhaust cylinder 26, respectively, which are located in the caldron: starting from combustion chamber 23, which is arranged somewhat eccentrically to axis A above the air cylinder, the pulsation pipe 24 goes first toward the interior wall of caldron 1 in such a manner that it leads to approximately point C, which may be defined as a point of tangency with exhaust cylinder 26, and proceeds in a circular curve tangentially and as close to the interior wall of the caldron 1 as possible. Following this circular line for slightly more than a semi-circle, the pulsation pipe 24 then circumvents B to point D. Pulsation pipe 24 then follows a straight piece from point D until it leads to E and then follows an imagined circle around A as close to caldron 1 as possible; from there, the pulsation pipe again follows a circular line for slightly more than a semicircle around A to F and then runs straight from F downwards to the opening in exhaust cylinder 26. This shape may be characterized as a "pretzel shape". Certainly, other curved, space saving shapes may be possible in order to achieve a predetermined length, for example, the form of a digit eight around the axes A and B, whereby, if necessary, some additional length could be gained, but whereby, due to the crossing point, slightly more space would be required.

At the right side of the housing 3 (in FIG. 2), the connection points 20', 5, 22', 32 for gas, water, electricity, and exhaust, respectively, are to be found.

Figure 3H:
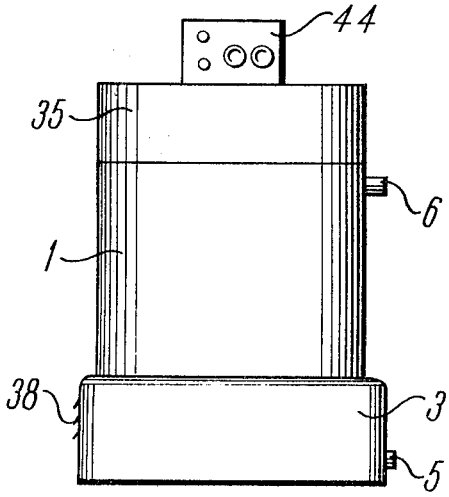
Figure 3A:
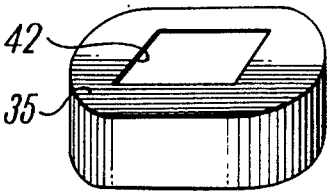
Figure 3B:
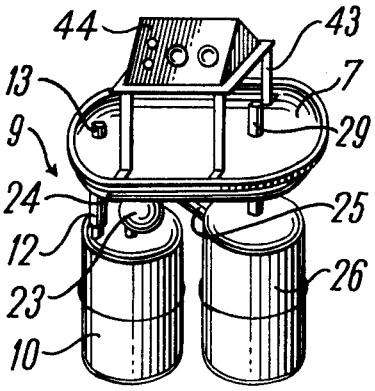
Figure 3C:
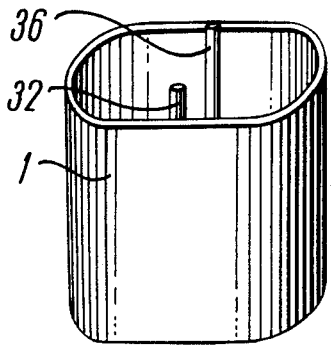
Figure 3D:
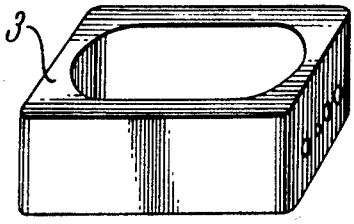
Figure 3E:
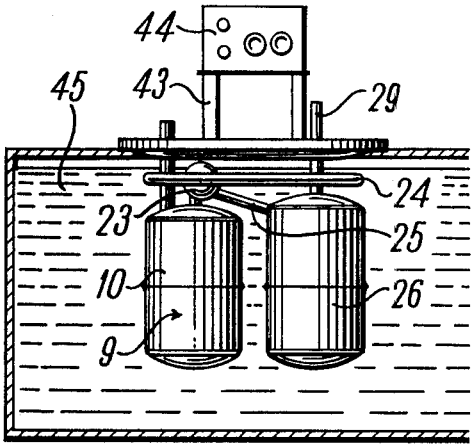

FIGS. 3*a*—*h* serve to clarify the particularly advantageous manufacturing and mounting achieved by the described arrangement of individual parts and mechanisms. First come separate assembly and preparation of cover housing 35 according to FIG. 3*a*, pulsation immersion heater mechanism 9 attached to cover 7 according to FIG. 3*b*, caldron 1 according to FIG. 3*c*, and the housing 3 according to FIG. 3*d*. To further clarify subsequent descriptions, it should be noted in the context that an instrumentation panel 44, mounted by means of supports 43 on cover 7, also belongs to the pulsation immersion heater mechanism 9. When mounted (cf. also FIG. 1), this panel extends through an opening 42 in cover housing 35. The advantage of this distribution of the mechanisms is that it is possible to test pulsation immersion heater system 9, as shown in FIG. 3*d* for performance although it is not yet fully assembled. This test may be made in a test water container 45 as shown in FIG. 3*e*. The only requirement is that corresponding connections for gas, electricity, etc. be available on the test location. The entire pulsation immersion heater mechanism 9 may be submerged in a water container 45 and be fully calibrated and tested for performance prior to final assembly.

Figure 3F:
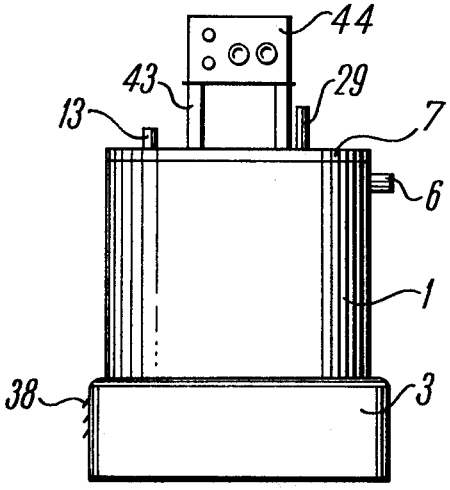
Figure 3G:
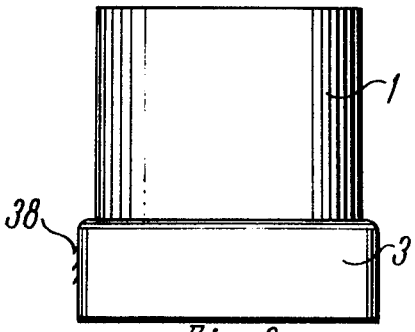

If this testing proceeds satisfactorily, pulsation immersion heater mechanism 9 may be placed in caldron 1, as shown in FIG. 3*f*, the caldron having previously been mounted on the housing 3 as shown in FIG. 3*g*. Then, as shown in FIG. 3*h*, cover housing 35 is mounted. FIG. 3*h* shows the complete assembly. Service is equally simple: it is only necessary to take off cover housing 35 and disengage the screws holding caldron cover 7. In this manner, the entire pulsation immersion heater mechanism 9 is easily accessible and may be immediately serviced or even—if repair is necessary—exchanged. Exchange of individual mechanisms is particularly simple for the same reason.

FIG. 4 and FIG. 5 show a construction sample with an increase of the heater performance to twice the original value. This is achieved by utilizing two combustion chambers and two pulsation pipes—with otherwise identical parts. As may be seen from FIG. 4, two combustion chambers 123-1 and 123-2 are located above air cylinder 110, connected with the cylinder in the manner shown in FIG. 6, each slightly eccentrically from the axis A. Their positioning relative to each other is achieved with an elevation difference of, for example, 30 mm in such a manner that the two pulsation pipes 124-1 and 124-2 exiting from them may be positioned directly above each other at this short distance and with basically identical shapes. At the ends 125-1 and 125-2, they are rotationally connected with each other via a coupling piece 146. This coupling piece serves to coordinate the pulsations in the two combustion chamber/-pulsation pipe systems in such a manner that the rotation constantly has a phase shift of 180° between the two. This secures the stability of both pulsation systems in counter-stroke. At the same time, the coupling piece 146 serves as stabilizer for the exhaust cylinder 126. Thus, insofar the cross-sections for the intake air have been selected with sufficient size for the embodiment with only one pulsation system, the simple measure of mounting two pulsation systems one above the other with an insignificant difference in total height, the effect achieved may be doubled. As can be seen from FIG. 5, only a slight mutual dislocation of the combustion chambers is necessary, namely in such a manner that, in relation to axis A, the combustion chamber 123-1 is located opposite from combustion chamber 123-2 in order to accommodate the two pulsation pipe pretzels one above the other. The cross-sections may be calculated from the outset for two pulsation systems and, if only one system is built in, the pipe diameter for fresh air and exhaust may be decreased by insertion of narrower pipe elements.

In order to obtain two pulsation combustion systems, indentical in regard to pulsation characteristics, the lengths of the mixing pipes must be identical, so that the connection points of the mixing pipes to the intake mufflers must be at different elevations. This may be seen from FIG. 6. From the combustion chambers 123-1 and 123-2, mixing pipes 118-1 and 118-2 lead to non-return valves 117-1 and 117-2, respectively. As may be seen, these are now located at different elevations on the intake muffler 115, resulting in equal lengths for the two mixing pipes and, consequently, also identical pulsation conditions. In order to achieve this result, the non-return valve 117-1 is attached at the end of a short attachment support 147 which opens into the intake muffler 115.

In conjunction with FIGS. 4 through 6 only those items have been described and elaborated upon, where the arrangement differs from that described with reference to FIGS. 1 and 2. In other areas, particularly the connection of parts to be mounted in the caldron with the pulsation immersion heater mechanism, reference should be made to the presentation in FIGS. 1 and 2.

Furthermore, it should be noted that the cross-section of caldron 1 may deviate from the form shown in FIG. 2 or FIG. 5 in that the caldron surrounding the side by side vertical cylinders may also be round or any other suitable shape. With a round caldron the volume of the caldron is increased. The round shape is also advantageous for stability. In other respects, the arrangement may remain the same—with corresponding adjustment of cover 7. For reasons of manufacturing, assembly, and service, air cylinder 10 and exhaust cylinder 26 are designed in two parts.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A continuous flow water heater, comprising:

a caldron, closed at its upper end by a caldron cover, and provided with a water intake at its lower end and a water outlet at its upper end beneath said cover, and a pulsating heating unit comprising, an air inlet conduit, a first vertically standing cylinder containing air intake sound muffling means, said air inlet conduit being connected to said first vertically standing cylinder, a combustion chamber above said first vertically standing cylinder, a fuel/air mixing means connected to said air intake sound muffling means and to said combustion chamber, a fuel intake conduit connected to said mixing means, a pulsating pipe connected to said combustion chamber and extending therefrom in a substantially horizontal plane, the end portion of said pulsating pipe being inclined downwardly from said plane, a second cylinder provided with an exhaust gas sound muffling means of approximately the same height as said first cylinder and arranged in parallel to and at the side of said first cylinder, said end portion of the pulsating pipe being connected to said second cylinder, and an exhaust gas conduit connected to said second cylinder whereby said pulsating heating unit is immersed in said caldron in a position between said water intake and said water outlet, and whereby said air inlet conduit, said fuel intake conduit and said exhaust gas conduit extend vertically downward from said cover to said first vertically standing cylinder, said mixing means and said second cylinder, respectively.

2. A continuous flow water heater in accordance with claim 1 wherein said pulsation pipe forms a substantially pretzel shape extending from said combustion chamber to a point of substantial tangency to the contour of said second cylinder, looping around said contour and subsequently looping around the contour of said first cylinder and opening with its end portion into said second cylinder.

3. A continuous flow water heater in accordance with claim 1 wherein the fuel/air-mixing means is located in the space formed above the air intake sound muffling means in said first vertically standing cylinder.

4. A continuous flow water heater in accordance with claim 3 wherein a check valve is mounted at the connection between said air intake sound muffling means and the fuel/air-mixing means at a position within said first vertically standing cylinder.

5. A continuous flow water heater in accordance with claim 3 wherein a spark plug for starting said pulsating heating unit and the connection of the fuel intake conduit to the fuel/air-mixing means is located above the air intake sound muffling means within said first vertically standing cylinder.

6. A continuous flow water heater in accordance with claim 1 wherein said fuel intake conduit leads into said first vertically standing cylinder through said air inlet conduit.

7. A continuous flow water heater in accordance with claim 1 wherein gas is used as a fuel.

8. A continuous flow water heater in accordance with claim 1 wherein an exhaust gas conduit extends into the second cylinder downward with its end ending shortly above the bottom of the same.

9. A continuous flow water heater in accordance with claim 1 wherein said exhaust gas sound muffling means is mounted above said caldron cover, into which an exhaust gas conduit is connected.

10. A continuous flow water heater in accordance with claim 1 wherein the intake of fresh air to a space formed between a housing cover and said caldron cover, which space is in communication with said air inlet conduit, is achieved by means of a pipe extending from a space below the bottom of the caldron, passing through the caldron, and extending into said space between said housing cover and said caldron cover.

11. A continuous flow water heater in accordance with claim 10 wherein a fuel supply line and an electrical supply line pass from said space below the caldron to said space between the caldron cover and the housing cover through said pipe.

12. A continuous flow water heater in accordance with claim 1 including an instrument panel provided above said caldron cover and attached thereto by means of supports, which, when a housing cover is placed over said caldron cover, said instrument panel extends through an opening in said housing cover.

13. A continuous flow water heater in accordance with claim 1 wherein said pulsating heating unit further comprises: a second combustion chamber located above said first cylinder, a second fuel/air-mixing means connected to said air intake sound muffling means and to said second combustion chamber, and a second pulsating pipe connected to said second combustion chamber and extending therefrom a substantially horizontal plane and substantially parallel to the first mentioned pulsating pipe, the end portion of said second pulsating pipe being inclined from said plane and connected to said second cylinder, whereby the length of the first mentioned fuel/air mixing means and the second fuel/air mixing means between the respective combustion chambers to which they are connected, and a check valve, by which each of said mixing means is connected to the first mentioned air intake sound muffling means, are equal.

14. A continuous flow water heater in accordance with claim 13 including a coupling piece between the interior spaces of said two pulsation pipes to obtain a phase shift of 180° of the pulsations taking place within the pulsation pipes in relation to each other.

15. A continuous flow water heater in accordance with claim 14 wherein the coupling pieces are mounted at the end of the two pulsation pipes.

16. A continuous flow water heater in accordance with claim 1 wherein said caldron is made of a synthetic material.

* * * * *